United States Patent [19]

Ide et al.

[11] Patent Number: 4,876,436

[45] Date of Patent: Oct. 24, 1989

[54] PTC AIR HEATER EMPLOYING TRIANGULAR PTC HEATING ELEMENTS

[75] Inventors: Mason G. Ide, Gorham, Me.; Noel L. W. Lawrence, London, Canada; Lee Prager, Raymond, Me.

[73] Assignee: GTE Products Corporation, Stamford, Conn.

[21] Appl. No.: 224,638

[22] Filed: Jul. 27, 1988

[51] Int. Cl.[4] ..... H05B 1/02; H05B 3/06; F24H 3/04

[52] U.S. Cl. ..... 219/370; 219/376; 219/382; 338/22 R

[58] Field of Search ..... 219/374–376, 219/381, 382, 205–207, 504, 505; 123/549; 338/22 R

[56] References Cited

U.S. PATENT DOCUMENTS

| | | | |
|---|---|---|---|
| 4,233,494 | 11/1980 | Pawlik et al. | 219/382 |
| 4,368,380 | 1/1983 | Igashira et al. | 219/206 |
| 4,703,153 | 10/1987 | Pelonis | 219/376 X |
| 4,717,813 | 1/1988 | Berg et al. | 219/381 X |

FOREIGN PATENT DOCUMENTS

| | | | |
|---|---|---|---|
| 1190579 | 7/1985 | Canada | 219/375 |
| 52-33160 | 3/1977 | Japan | 219/376 |
| 54-40344 | 3/1979 | Japan | 219/375 |
| 56-12950 | 2/1981 | Japan | 219/375 |
| 56-59156 | 5/1981 | Japan | 219/375 |

*Primary Examiner*—Anthony Bartis
*Attorney, Agent, or Firm*—James Theodosopoulos

[57] ABSTRACT

An electrically powered forced air heater includes six triangular PTC heating elements co-planarly disposed within a circular shroud with a apex of each element being disposed adjacent a common central point and the sides of the six PTC heating elements which are opposite the aforesaid apexes forming a hexagon. The area collectively occupied by the six PTC heating elements is greater than 78% of the cross sectional area of the circular shroud. The PTC heating elements are provided with a multiplicity of air flow holes therethrough and an electric fan is arranged to force air through the holes without interference with the rotational component of the fan-forced air vortex before the fan forced air strikes the PTC heating elements.

7 Claims, 2 Drawing Sheets

PTC AIR HEATER EMPLOYING TRIANGULAR PTC HEATING ELEMENTS

This invention concerns air heaters utilizing PTC's as heating elements. An example of such an air heater is shown in U.S. Pat. No. 4,703,153 where the heating elements comprise four co-planar circular PTC disks. The PTC disks are held between two ceramic holding members which are shaped to provide flared passages to guide air flow smoothly towards the PTC disks, the air flow being provided by an electric fan.

An air heater as per the instant invention utilizes triangular PTC heating elements instead of circular ones. Advantageously, six such triangular PTC's can be co-planarly positioned in a hexagonal pattern to occupy a greater percentage of the cross sectional area of the cylindrical duct through which the fan-forced air flows to be heated, than can four co-planarly positioned circular PTC's, for example, 92% versus 78%. This permits the individual holes through each PTC to be increased in size, thereby reducing back pressure in the heater. Also, the larger individual holes clog less readily.

Figure 1:
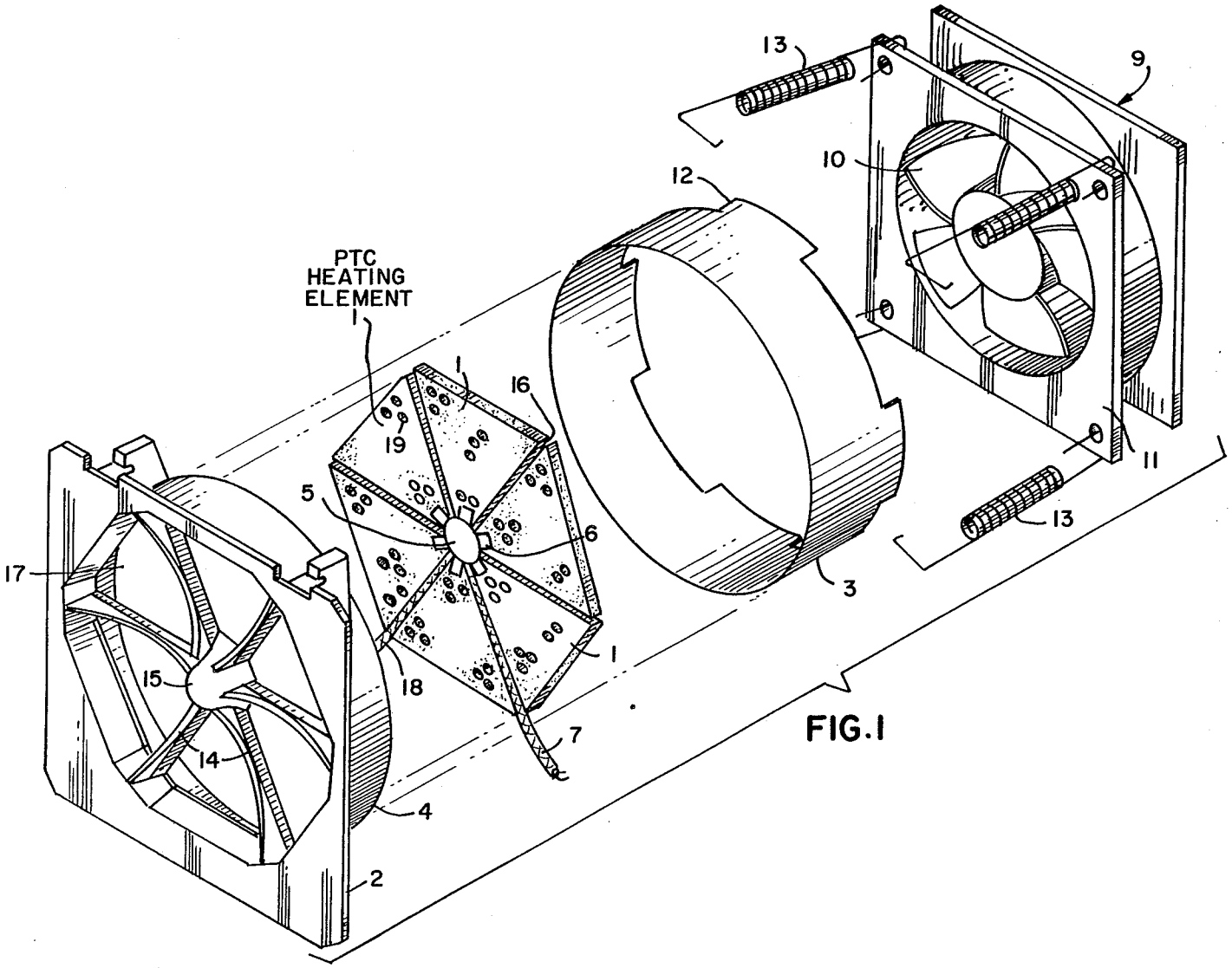
FIG. 1 is an exploded view of a heater in accordance with this invention.
Figure 2:
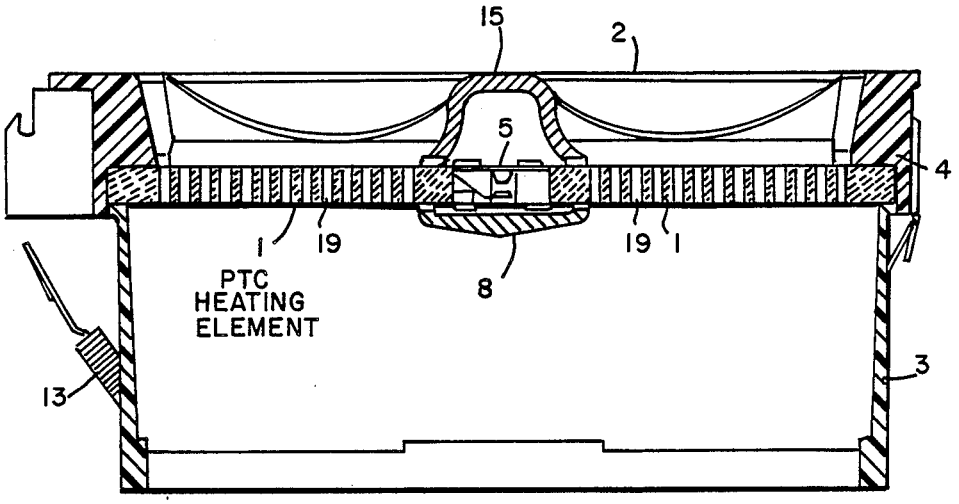
FIG. 2 is a cross sectional view.

As shown in the drawing, the heater contains six triangular PTC heating elements 1 each having a multiplicity of holes 19 therethrough for air to pass through to be heated. PTC elements 1 fit into six triangular recesses 17 of face plate 2. A cylindrical duct or shroud 3 fits into cylindrical portion 4 of face plate 3 and rests against the outer corners of PTC elements 1, thereby holding PTC elements 1 in place in the triangular recesses in cylindrical portion 4 of face plate 3. Electrical contact to PTC elements 1 is provided by a metal spring contact 5 having fingers 6 contacting the forward electroded faces at the inner corner of the six PTC elements 1. Lead-in wire 7, which is connected to spring contact 5, fits into a trough 16 between two adjacent PTC elements 1 and extends out through a slot (not shown) in cylindrical portion 4. A similar contact arrangement (not shown in FIG. 1) in back of the six PTC elements 1 makes electrical contact with the rearward electroded faces of PTC elements 1. Covering the back spring contact is a narrow beam 8 (not shown in FIG. 1) which covers the trough 16 in which back lead-in wire 18 rests and which has a circular central portion to cover the back spring contact. Beam 8 is held in place by cylindrical shroud 3 resting against narrow projections at each end of beam 8.

Fan assembly 9 comprises an electric fan 10 and a square mounting plate 11. Four projections 12 on cylindrical shroud 3 straddle the sides of mounting plate 11 to properly mount and position shroud 3. Fan assembly 9, cylindrical shroud 3 and face plate 2 are held together by four coiled springs 13.

In one example, triangular PTC elements 1 were equilateral, approximately 2.29" each side, and ¼" thick. There were 423 holes, 53 mils in diameter, in each PTC element. The maximum width of each rib 14 of face plate 2, which ribs provided part of the triangular recesses for the PTC elements, was 5/16". The maximum diameter of hub 15 of face plate 2, which hub 15 covered spring contact 5, was 1⅛". The inside diameter of cylindrical portion 4 of face plate 2 was 5 7/32". Troughs 16 between the PTC elements were about ¼" wide.

Cylindrical shroud 3 was 3/32" thick, 1½ long (excluding projections 12), and had an outside diameter of 5 3/16". Beam 8 was 5 3/16" long and 5/16" wide except for the central portion which was 1⅛" diameter. Face plate 2, cylindrical shroud 3 and beam 8 were all made of molded high temperature plastic.

This arrangement of PTC elements 1, shroud 3 and mounting plate 11 provides complete openess between fan 10 and the back faces of the PCT elements. The advantage of this is that there are no obstructions to interfere with the rotational component of the fan vortex, which results in improved air flow and thus improved transfer heat from the PTC elements to the air.

For electrical contact to the PTC elements, in lieu of spring contact 5, wires may be welded to each PTC element, which wires are then connected to lead-in wires 7 and 18. For such welding, the ultrasonic welding process disclosed in U.S. Pat. No. 4,730,102 may be used.

We claim:

1. An air heater comprising: six triangular PTC heating elements co-planarly disposed within a circular shroud; an apex of each triangular PTC heating element being adjacent a common central point; the sides of the six triangular PTC heating elements, which are opposite the apexes adjacent a common central point, forming a hexagon; the area occupied by the six triangular PTC heating elements being greater than 78% of the cross sectional area of the circular shroud; each PTC element having a multiplicity of holes therethrough; means for forcing air within the shroud through the holes in the PTC elements to be heated when the PTC elements are electrically energized; and means for electrically energizing the PTC elements.

2. The air heater of claim 1 wherein said air forcing means comprises an electric fan, the construction of the air heater and shroud being such that there are no parts within the shroud between the fan and PTC elements to substantially interfere with the rotational component of the fan-forced air vortex before the fan-forced air strikes the PTC elements.

3. The air heater of claim 1 wherein a pair of PTC elements are closely spaced to form a narrow trough therebetween, wherein said means for electrically energizing the PTC elements includes a lead-in wire, and wherein said lead-in wire rests in said narrow trough.

4. The air heater of claim 1 comprising, in addition, a face plate containing six triangular co-planar recesses in which said six triangular PTC heating elements are disposed.

5. The air heater of claim 4 including a fan assembly, the fan assembly comprising an electric fan and a mounting plate, the circular shroud fitting between the face plate and the mounting plate and resting against the outer corners of the PTC elements.

6. The air heater of claim 5 wherein there are four projections on the shroud which straddle the sides of the mounting plate.

7. The air heater of claim 6 wherein the fan assembly, shroud and face plate are held together by four coiled springs extending between the face plate and fan assembly.

* * * * *